US006273168B1

(12) United States Patent
Kawamura et al.

(10) Patent No.: US 6,273,168 B1
(45) Date of Patent: Aug. 14, 2001

(54) APPARATUS AND METHOD FOR AUTOMATICALLY ADHERING TAPES

(75) Inventors: Masanori Kawamura, Aichi-ken; Takashi Yamamoto, Nagoya, both of (JP)

(73) Assignees: Kabushiki Kaisha Isowahooperswift, Kasugai; Lintec Kabushiki Kaisha, Tokyo; Ogura Kogyo Kabushiki Kaisha, Nagoya, all of (JP)

( * ) Notice: Subject to any disclaimer, the term of this patent is extended or adjusted under 35 U.S.C. 154(b) by 0 days.

(21) Appl. No.: 09/306,864

(22) Filed: May 7, 1999

(30) Foreign Application Priority Data

May 7, 1998 (JP) ..... 10-125026

(51) Int. Cl.[7] ..... B32B 31/00; B65H 19/18

(52) U.S. Cl. ..... 156/517; 156/519; 156/522; 156/552; 156/265; 156/270; 156/302; 242/556.1; 242/583

(58) Field of Search ..... 156/522, 520, 156/519, 506, 505, 270, 265, 159, 302, 517, 552; 242/556.1, 583

(56) References Cited

U.S. PATENT DOCUMENTS

| | | | | |
|---|---|---|---|---|
| 4,543,152 | * | 9/1985 | Nozaka | 156/502 |
| 4,685,392 | | 8/1987 | Watanabe | 101/226 |
| 4,812,198 | | 3/1989 | Fuke et al. | 156/497 |
| 5,658,420 | | 8/1997 | Rossini | 156/504 |
| 5,783,029 | * | 7/1998 | Stettner et al. | 156/510 |

FOREIGN PATENT DOCUMENTS

| | | |
|---|---|---|
| 0 487 107 | 5/1992 | (EP) . |
| 0 692 445 | 1/1996 | (EP) . |

* cited by examiner

*Primary Examiner*—Linda Gray
(74) *Attorney, Agent, or Firm*—Stroock & Stroock & Lavan LLP

(57) ABSTRACT

An apparatus for automatically adhering tapes adheres a double-faced adhesive tape to a tip portion of a stock paper roll around which a stock paper is wound and adheres at least one fixing adhesive tape so as to bridge the tip portion and the stock paper roll. The apparatus includes a device for transporting the double-faced adhesive tape. The transporting device includes an endless belt transporting the double-faced adhesive tape while at the same time holding the double-faced adhesive tape on its transporting surface. The apparatus further includes a device for feeding the double-faced adhesive tape. The feeding device feeds the double-faced adhesive tape to the transporting surface of the endless belt while simultaneously stripping a strip paper adhered to one face of the double-faced adhesive tape. The apparatus further includes a device for feeding the fixing adhesive tape. The feeding device cuts a continuous fixing adhesive tape to a predetermined length and adheres the cut fixing adhesive tape by an adhering surface thereof to the double-faced adhesive tape held on the endless belt with a portion of the fixing adhesive tape extending beyond the double-faced adhesive tape. The apparatus still further includes a device for cutting the double-faced adhesive tape to a predetermined length and a device for adhering the double-faced adhesive tape and the fixing adhesive tape.

7 Claims, 13 Drawing Sheets

APPARATUS AND METHOD FOR AUTOMATICALLY ADHERING TAPES

BACKGROUND OF THE INVENTION

1. Field of the Invention

The present invention relates to an apparatus and a method for automatically adhering tapes, more particularly, to an apparatus and a method capable of automatically adhering a double-faced adhesive tape for splicing papers and a fixing adhesive tape for fixing a tip portion of a stock paper to a side of a stock paper roll to the tip portion of the stock paper in a stock paper wound roll.

2. Description of the Related Art

A stock paper roll including a hollow core around which a continuous stock paper such as a long continuous paper, film, or metal foil or a composite sheet such as a laminated film, etc. is wound has been widely used in various kinds of applications in many industries. For instance, in off-set and rotary letterpress printing machines, a roll body (referred to as a stock paper roll hereinafter) around which a web (referred to as a stock paper hereinafter) to be printed is wound in a rolled manner is loaded on a stock paper feeding device from which the stock paper is fed.

Apart from the stock paper roll currently being fed, the stock paper roll of the same or another kind is loaded on the stock paper feeding device to stand by. When the diameter of the current stock paper roll becomes small, or when the stock paper roll is to be replaced with the stock paper roll of another standard due to an order change, the terminal end of the current stock paper roll and the tip portion of the standby stock paper roll are spliced by a splicer provided on the stock paper feeding device. When paper is spliced by the splicer, double-faced adhesive tape has to be adhered in advance to the tip portion of the stock paper of a new stock paper roll to be spliced. For this reason, a length of double-faced adhesive tape is adhered to the tip portion of the stock paper at the operation site before the stock paper roll is loaded on the stock paper feeding device.

Since the operation for adhering the double-faced adhesive tape to the tip portion of the stock paper roll has been manually conducted up to now, no labor saving has been possible. In addition, when the stock paper roll is transported for loading on the stock paper feeding device, the stock paper may accidentally be drawn out of the stock paper roll unless the tip portion of the stock paper is fixed on the stock paper roll. Therefore, apart from the double-faced adhesive tape for splicing, fixing adhesive tape for fixing the tip portion of the stock paper roll to the side of the stock paper roll is manually adhered to a plurality of positions on the stock paper roll widthwisely spaced apart from each other. Such being the case, the manual operation for adhering the double-faced adhesive tape and the fixing adhesive tape is time-consuming and can interfere with labor saving and automation of the entire production line.

SUMMARY OF THE INVENTION

The present invention was accomplished to eliminate the disadvantages caused by the foregoing problems. The object of the present invention is to provide an apparatus and a method for automatically adhering tapes capable of automating adherence of a double-faced adhesive tape and a fixing adhesive tape to a tip portion of a stock paper of a stock paper wound roll, thereby saving time and labor.

This object is achieved according to the present invention in one aspect thereof by providing an apparatus for automatically adhering tapes, which adheres a double-faced adhesive tape (10) to a tip portion (11*a*) of a stock paper roll (11) around which a stock paper is wound and adheres at least one fixing adhesive tape (12) so as to bridge the tip portion and the stock paper roll, the apparatus comprising means (A) for transporting the double-faced adhesive tape which includes an endless belt (15) transporting the double-faced adhesive tape while at the same time holding the double-faced adhesive tape on its transporting surface, means (B) for feeding the double-faced adhesive tape which feeds the double-faced adhesive tape to the transporting surface of the endless belt while simultaneously stripping a strip paper (21) adhered to one face of the double-faced adhesive tape, means (D) for feeding the fixing adhesive tape which cuts a continuous fixing adhesive tape to a predetermined length and adheres the cut fixing adhesive tape by an adhering surface thereof to the double-faced adhesive tape held on the endless belt with a portion of the fixing adhesive tape extending beyond the double-faced adhesive tape, means (C) for cutting the double-faced adhesive tape to a predetermined length, and means (E) for adhering the double-faced adhesive tape and the fixing adhesive tape including posture changeable means (56, 67) which takes a first posture in which the double-faced adhesive tape and the fixing adhesive tape both held on the endless belt are received and a second posture in which the double-faced adhesive tape and the fixing adhesive tape are adhered, the posture changeable means receiving the double-faced adhesive tape and the fixing adhesive tape at the first posture is shifted to take the second posture, whereby the posture changeable means and said stock paper roll are brought close in order for the double-faced adhesive tape to be adhered to the tip portion of the stock paper and in order for the fixing adhesive tape to be adhered to the tip portion of the stock paper and the stock paper roll in a bridging manner.

This object is achieved according to the present invention in another aspect thereof by providing a method for automatically adhering tapes, which adheres a double-faced adhesive tape to a tip portion of a stock paper roll around which a stock paper is wound and adheres at least one fixing adhesive tape to bridge the tip portion and the stock paper roll, the method comprising the steps of conducting and halting the transportation of the double-faced adhesive tape intermittently while sucking and thus holding the double-faced adhesive tape on a transporting surface of an endless belt, cutting the fixing adhesive tape to a predetermined length during a halt of the transportation of the endless belt while facing an adhesive surface of the fixing adhesive tape toward the double-faced adhesive tape held on the endless belt to adhere the fixing adhesive tape to the double-faced adhesive tape in such a way that the fixing adhesive tape extends beyond the double-faced adhesive tape, cutting the double-faced adhesive tape to a predetermined length; and adhering the double-faced adhesive tape to the tip portion of the stock paper while adhering the fixing adhesive tape to the tip portion of the stock paper and the stock paper roll in a bridging manner by receiving and holding the double-faced adhesive tape held on the endless belt and the fixing adhesive tape by a posture changeable means and then changing the posture of the posture changeable means which receives both adhesive tapes while bringing a tape holding surface of the posture changeable means and the stock paper roll close relative to each other.

BRIEF DESCRIPTION OF THE DRAWINGS

The features of this invention that are believed to be novel are set forth specifically in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
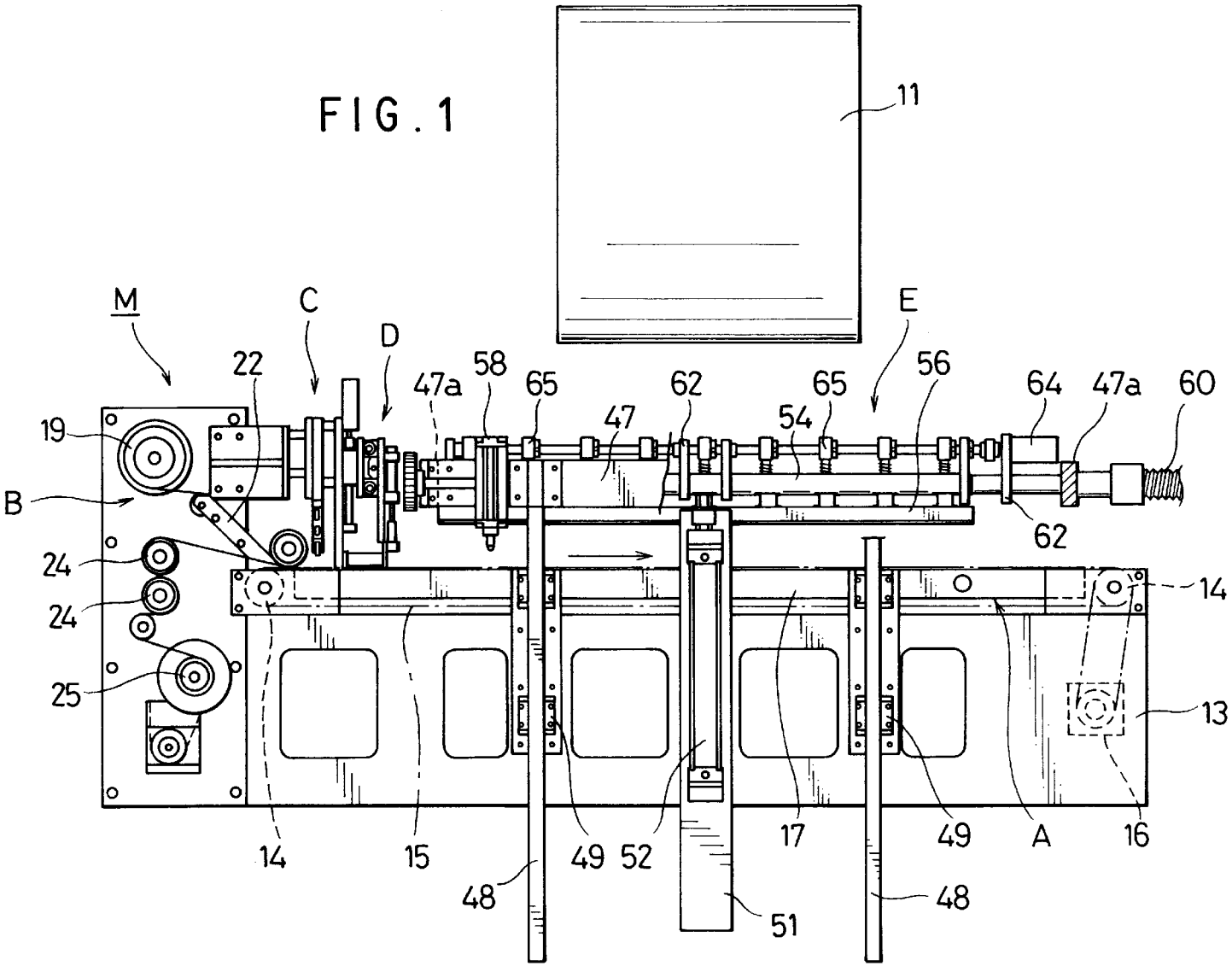
FIG. 1 shows a schematic plan view of the apparatus for automatically adhering tapes of a preferred embodiment according to the present invention.

Preferred embodiments of the apparatus and method for automatically adhering tapes according to the present invention will be described with reference to the drawings. FIG. 1 schematically shows the overall structure of the apparatus for automatically adhering tapes according to a first embodiment of the invention. The apparatus M is basically comprised of a tape transporting device A which transports a double-faced adhesive tape cut to a predetermined length to a position facing the stock paper roll (the stock paper wound roll) 11 located at a standby position, a first feeding device B for the double-faced adhesive tape which feeds the double-faced adhesive tape to the tape transporting device A, a cutting device C which cuts the double-faced adhesive tape, a second tape feeding device D which adheres a fixing adhesive tape to the double-faced adhesive tape transported by the tape transporting device A, and a tape transferring device E which adheres the fixing adhesive tape 12 to the stock paper roll 11. The stock paper roll 11 at the standby position is oriented with its stock paper tip portion 11*a* held downward to face the tape transferring device E.

The Tape Transporting Device

Figure 3:
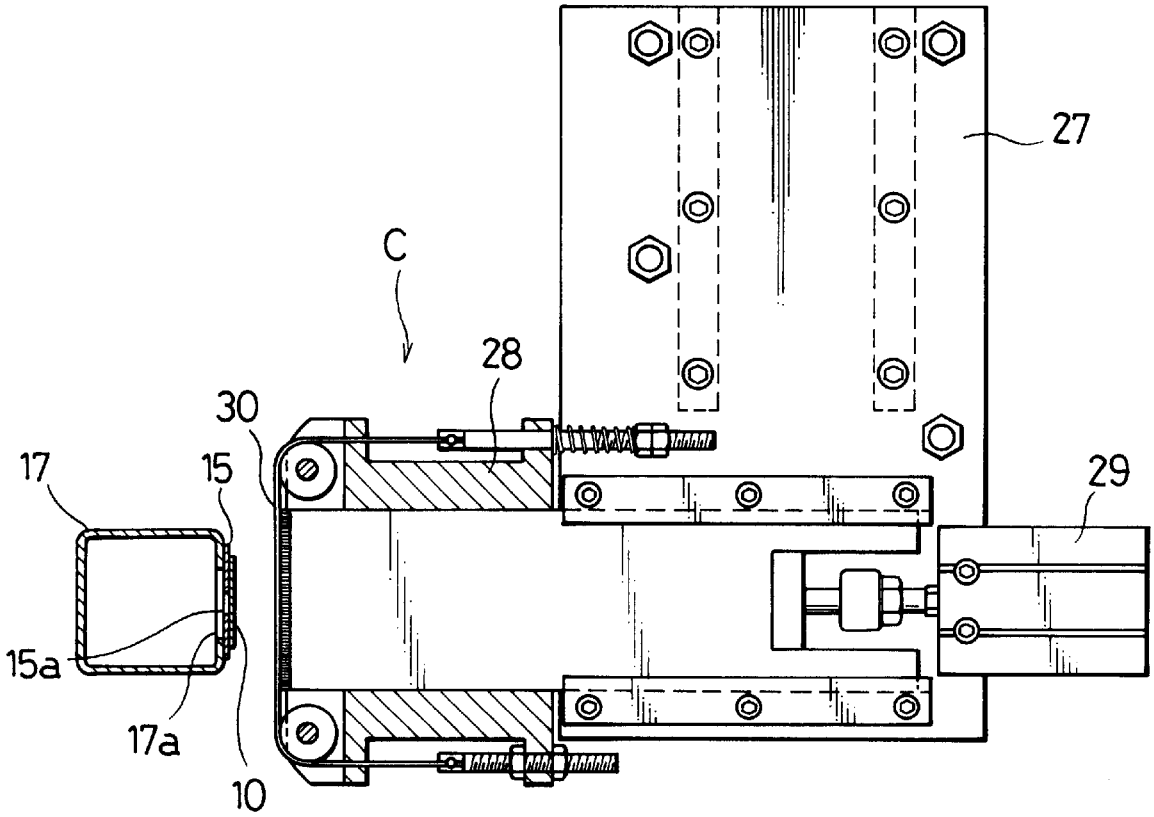
FIG. 3 shows a sectional side view of the cutting device of the preferred embodiment.

As shown FIG. 1, a pair of pulleys 14 are rotatably provided on an upper surface of the frame 13 of the apparatus. The pulleys are spaced apart in the widthwise direction of the stock paper roll 11, which is held in the standby position by conventional means (not shown) such as a lifter, a fork lift, or the like. An endless belt 15 is wound around the pair of pulleys 14 with its transporting surface extending vertically. A transporting motor 16 is connected to one of the pulleys 14 to rotate in a predetermined direction so as to run the endless belt 15 in a predetermined direction (that indicated by an arrow in FIG. 1). In the tape transporting device A, a negative pressure box 17 which communicates with a vacuum suction source (not shown) is provided at a transporting section between the upstream and downstream portions of the endless belt 15. In addition, as shown in FIG. 3, the double-faced adhesive tape 10 is adapted to be sucked onto, and thus held on, the transporting surface at the front side of the endless belt 15 (that is directed toward the stock paper roll 11 at the standby position) by developing a negative pressure within the negative pressure box 17 due to the communication of an opening 17*a* of the negative box 17 formed on the front face which faces the stock paper roll 11 with a plurality of perforated holes 15*a* formed on the endless belt 15. Since the endless belt 15 is in contact with the adhering surfaces of the double-faced adhesive tape 10 and the fixing adhesive tape 12, and is contacted by a heated cutting member 30 described later, the endless belt 15 is made of a material to which the adhesive tapes 10, 12 does not easily adhere and which has heat resistance. Such materials include silicon, nylon, etc.

The First Feeding Device for the Double-faced Adhesive Tape

Figure 2:
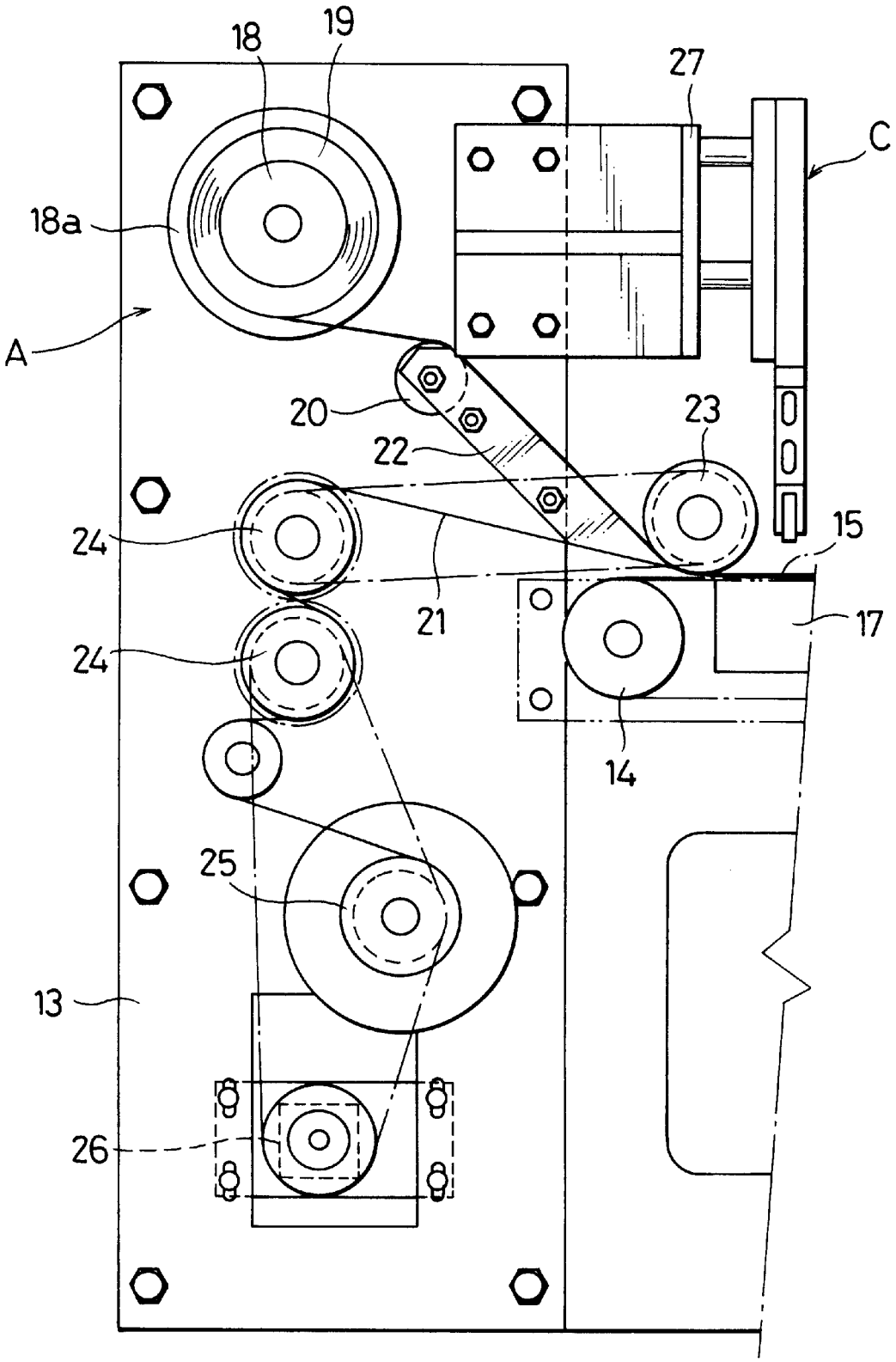
FIG. 2 shows a plan view of the first feeding device of the preferred embodiment.

The first feeding device B is provided on the frame 13 of the apparatus upstream in the transporting direction from the position where the endless belt 15 is provided to feed toward the endless belt 15 the double-faced adhesive tape 10 for splicing papers to the stock paper tip portion 11*a* of the stock paper roll 11. Namely, as shown in FIG. 2, a vertical holder 18 including a flange 18*a* is rotatably provided on the upper surface of the frame 13 of the apparatus, and a tape roll 19 as a feed source on which the double-faced adhesive tape 10 is wound to a certain diameter is detachably loaded on the vertical holder 18 to rest on the upper surface of the flange 18*a*. The double-faced adhesive tape 10 of the tape roll 19 loaded on the holder 18 is fed toward the endless belt 15 of the tape transporting device A via an appropriately located guide roller 20. The double-faced adhesive tape 10 has a strip paper 21 adhered to its one surface. A stripping plate 22 is disposed between the guide roller 20 and the endless belt 15 and is configured in such a way that the strip paper 21 guided along the stripping plate 22 to face the side of the stripping plate 22 of the adhesive tape 10 is folded at an open end portion of the stripping plate facing the endless belt 15 to be stripped from the double-faced adhesive tape 10. In addition, a feed roller 23, which cooperates with the endless belt 15 to sandwich the double-faced adhesive tape 10 from which the strip paper 21 has been stripped off, is rotatably provided near the open end of the stripping plate 22. The double-faced adhesive tape 10 is drawn out from the tape roll 19 by rotating the roller 23 during travel of the endless belt 15.

Two stripping rollers 24 and a winding roller 25 are rotatably provided on the upper surface of the frame 13 of the apparatus. The strip paper 21 stripped off the double-faced adhesive tape 10 is wound by the winding roller 25 via the stripping rollers 24. The feed roller 23, the stripping rollers 24, and the winding roller 25 are intermittently rotated by a common drive motor 26.

The Cutting Device of the Double-faced Adhesive Tape

The cutting device C is provided downstream in the transporting direction from the feeding position where the double-face adhesive tape is fed and at a position facing the transporting surface of the endless belt 15 by which the double-faced adhesive tape 10 on the endless belt 15 is sucked and thus held. In the cutting device, as shown in FIG. 3, a holder 28 is provided on a stationary frame 27 mounted on the frame 13 of the apparatus. The holder 28 is movable to and fro and can be moved toward or away from the endless belt 15 by forwardly and reversely energizing a cutting cylinder 29 provided on the stationary frame 27. The electrically heatable cutting member 30 (for instance, an electrical heater) is mounted on the holder 28 to face the endless belt 15 and extend vertically. More specifically, the double-faced adhesive tape 10 held on the endless belt 15 by suction is melted and thus cut by energizing the cutting cylinder 29 to bring the holder 28 close to the endless belt 15, whereby the cutting member 30 abuts against the double-faced adhesive tape 10.

The Second Feeding Device for the Fixing Adhesive Tape

Figure 4:
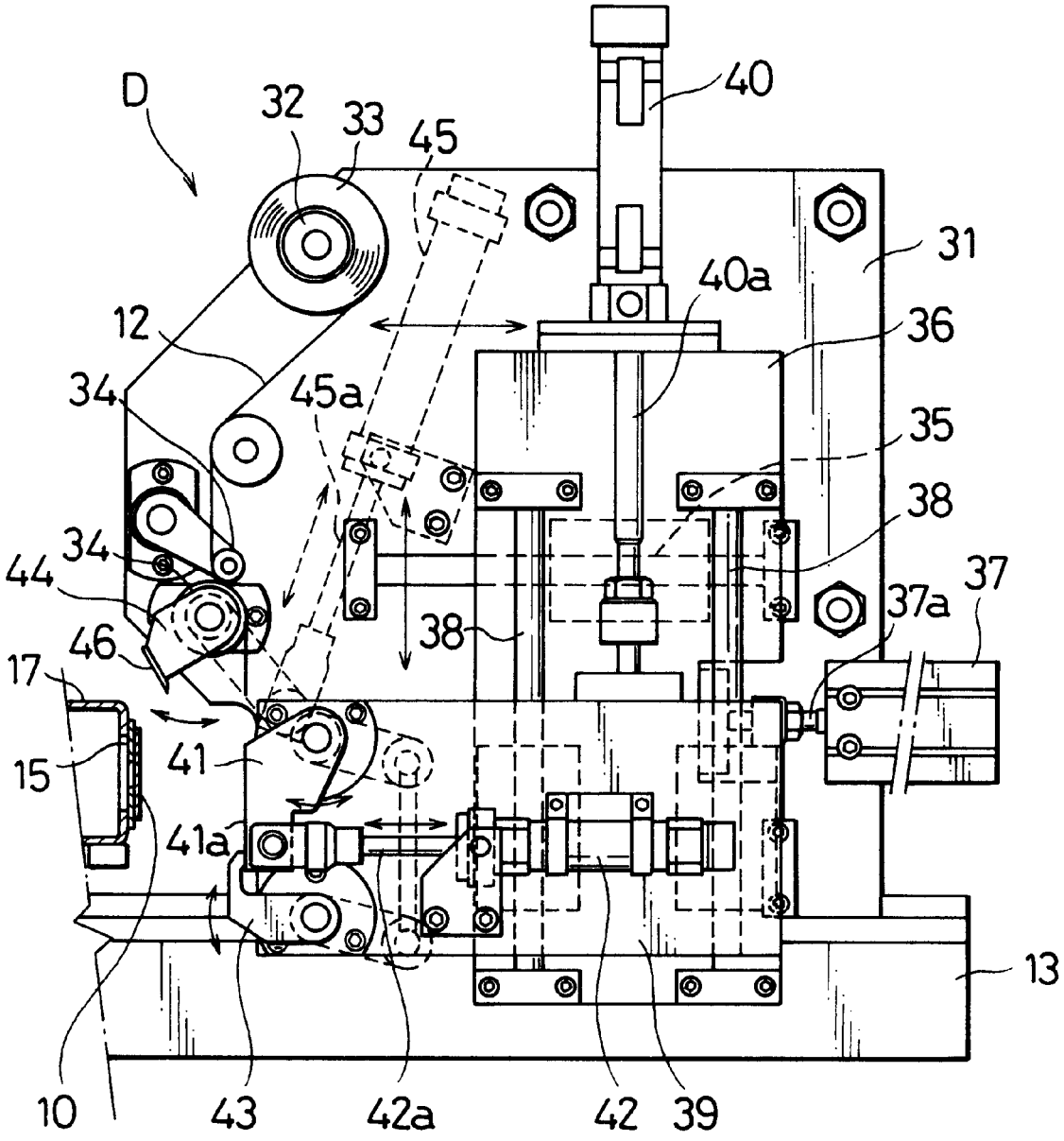
FIG. 4 shows a side view of the second feeding device of the preferred embodiment.

The second feeding device D, which adheres the fixing adhesive tape 12 for fixing the tip portion of the stock paper roll 11 to the stock paper roll to the double-faced adhesive tape 10 held on the endless belt 15 by suction, is provided downstream in the transporting direction of the endless belt 15 from the position where the cutting device is provided and at a position facing the endless belt 15. Namely, as shown in FIG. 4, a base plate 31 of the second feeding device D is disposed perpendicular to the frame 13 of the apparatus. A holder 32 protruding horizontally from a side face of the base plate 31 is rotatably provided near an upper rear end thereof (the end adjacent to the endless belt 15). A tape roll 33 around which the single-faced fixing adhesive tape 12 is wound is removably loaded on the holder 32. A pair of upper and lower guide rollers 34 are rotatably provided on the portion of the base plate 31 below the holder 32. The fixing adhesive tape 12 drawn out from the tape roll 33 is sandwiched and wound between the pair of guide rollers 34. The tip portion of the fixing adhesive tape 12 wound around the rollers 34 is suspended from the lower roller 34 to a predetermined length, with its adhesive face facing the endless belt 15.

A pair of horizontal guide rods 35 (only one is shown) extending from the front to the rear are provided on the base plate 31. The guide rods 35 are parallel and vertically spaced apart from each other. A first carriage 36 is slidably provided on the guide rods 35. A piston rod 37*a* of a cylinder 37 provided on the front portion of the base plate 31 is connected to the first carriage 36. By forwardly and reversely energizing the cylinder 37, the first carriage 36 can be moved between a standby position (FIG. 9) where it is away from the endless belt 15 and an adhering position (FIG. 10) where it is close to the endless belt 15. In addition, a pair of vertical guide rods 38 are provided on the first carriage 36. The vertical guide rods 38 are parallely spaced apart from each other in the front-rear direction, and a second carriage 39 is slidably mounted on the guide rods 38. A piston rod 40*a* of a cylinder 40 provided on the upper portion of the first carriage 36 is connected to the second carriage 39. By forwardly and reversely energizing the cylinder 40, the second carriage 39 can be moved between a grip position (FIG. 8) where the fixing adhesive tape 12 is gripped and a draw position (FIG. 9) where it is drawn.

An adhering member 41 is pivotably mounted near the rear portion of the second carriage 39. A piston rod 42*a* of a cylinder 42 provided on the second carriage 39 is connected to the adhering member 41. In addition, a gripping member 43 connected to the adhering member 41 by a suitable mechanism is rotatably provided below the adhering member 41 and on the second carriage 39. The gripping member 43 abuts against the lower end of a press surface 41*a* of the adhering member 41. The press surface 41*a* faces the endless belt 15. The adhering member 41 and the gripping member 43 are moved toward and away from each other (see FIGS. 8 and 9) by forwardly and reversely energizing the gripping cylinder 42, and when they are moved toward each other, they grip the tip portion of the fixing adhesive tape 12 suspended from the lower guide roller 34.

Figure 16:
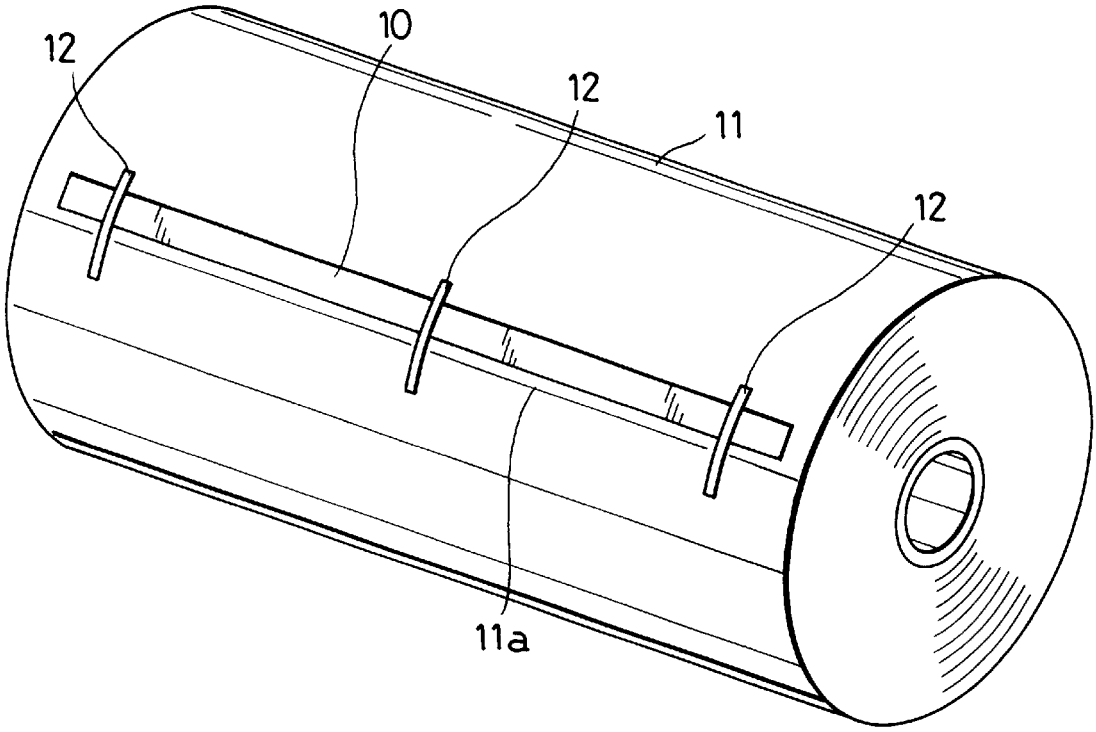
FIG. 16 shows a perspective view of the stock paper roll to the tip portion of which the fixing adhesive tape and the double-faced adhesive tape are adhered by the apparatus for automatically adhering tapes of the preferred embodiment.

A knife holder 44 is swingably provided on the base plate 31, and a piston rod 45*a* of a cylinder 45 provided on the base plate 31 is connected to the knife holder 44. A knife 46 is provided on the portion of the knife holder 44 behind the fixing adhesive tape 12 suspended from the lower guide roller 34. The fixing adhesive tape 12 the tip portion of which is gripped by the adhering member 41 and the gripping member 43 is cut at a position below the lower guide roller 34 by forwardly and reversely energizing the cylinder 45 to swing the knife holder 44. The length of the fixing adhesive tape 12 cut by the knife 46 is set in such a way that its longitudinal opposite ends vertically extend to a certain length beyond the double-faced adhesive tape 10 held on the endless belt 15 by suction, and that, as described later, the fixing adhesive tape 12 bridges between the tip portion 11*a* of the stock paper roll 11 and the stock paper roll when the double-faced adhesive tape 10 is adhered to the tip portion 11*a* of the stock paper roll 11(see FIG. 16).

The Tape Transferring Device

The tape transferring device E adheres the double-faced adhesive tape 10 and the fixing adhesive tape 12, which are held on the endless belt 15 by suction, to the tip portion 11*a* of the stock paper roll 11. It is provided between the tape transporting device A and the stock paper roll 11 which is positioned at the standby position. In the tape transferring device E, as shown in FIG. 1, a pair of guide members 48 are provided on the upper surface of a C-shaped frame 47 opening downwardly. The guide members 48 are spaced apart from each other in the longitudinal direction (the widthwise direction of the stock paper roll 11) and are sidable in the front-rear direction relative to a pair of guide rails 49, each of which is provided on the frame 13 of the apparatus. A support guide 50 is provided on the frame 13 of the apparatus between the guide rails 49, and a retaining frame 51 is provided on the support guide 50 to be sidable in the front-rear direction.

Figure 5:
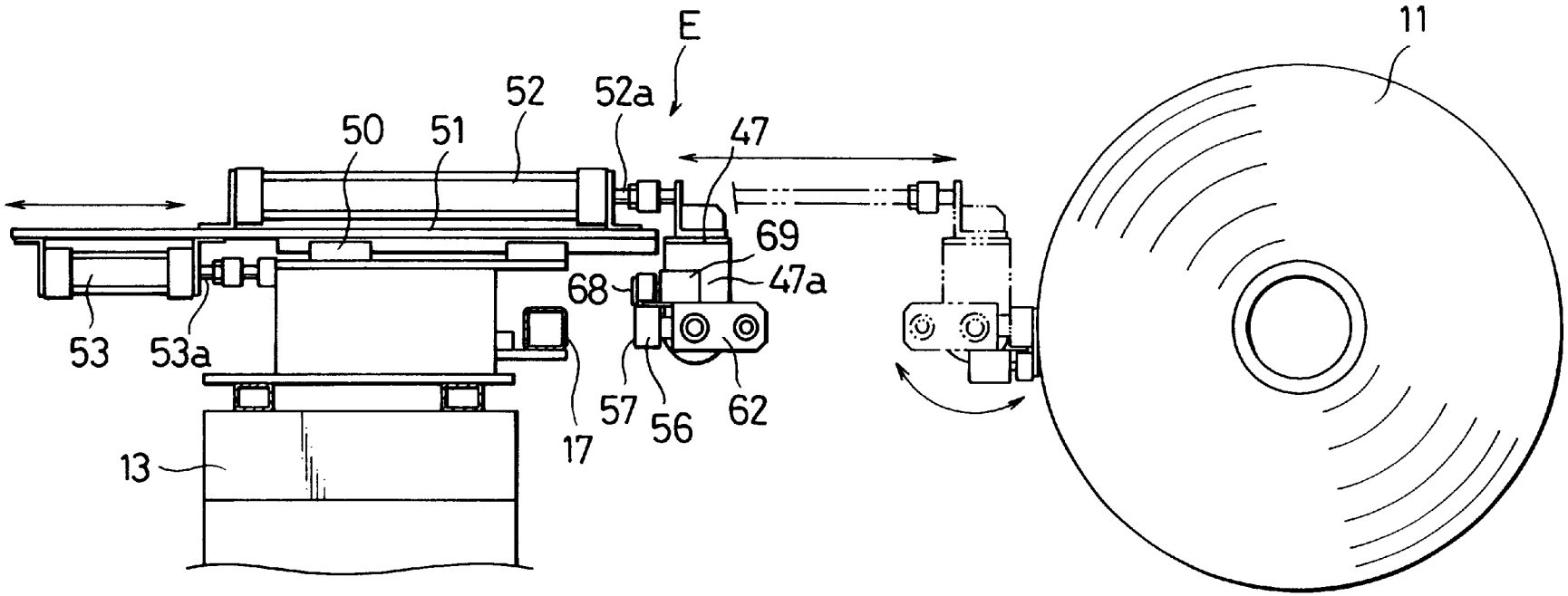
FIG. 5 shows a side view of the tape transporting device of the preferred embodiment.

As shown in FIG. 5, a piston rod 52*a* of a first cylinder 52 provided on the upper surface of the retaining frame 51 is connected to the C-shaped frame 47, so that the C-shaped frame 47 can be moved to and fro relative to the retaining frame 51 by forwardly and reversely energizing the cylinder 52. In addition, a piston rod 53*a* of a second cylinder 53 provided on the lower surface of the retaining frame 51 is connected to the frame 13 of the apparatus, so that the retaining frame 51 and the C-shaped frame 47 can be integrally moved to and fro relative to the frame 13 by reversely energizing the cylinder 53. The first cylinder 52 selves as means for moving main- and sub-transferling members 56, 67, described later, relative to the stock paper roll 11, while the second cylinder 53 serves as means for moving these transferring members 56, 67 relative to the endless belt 15.

Figure 6:
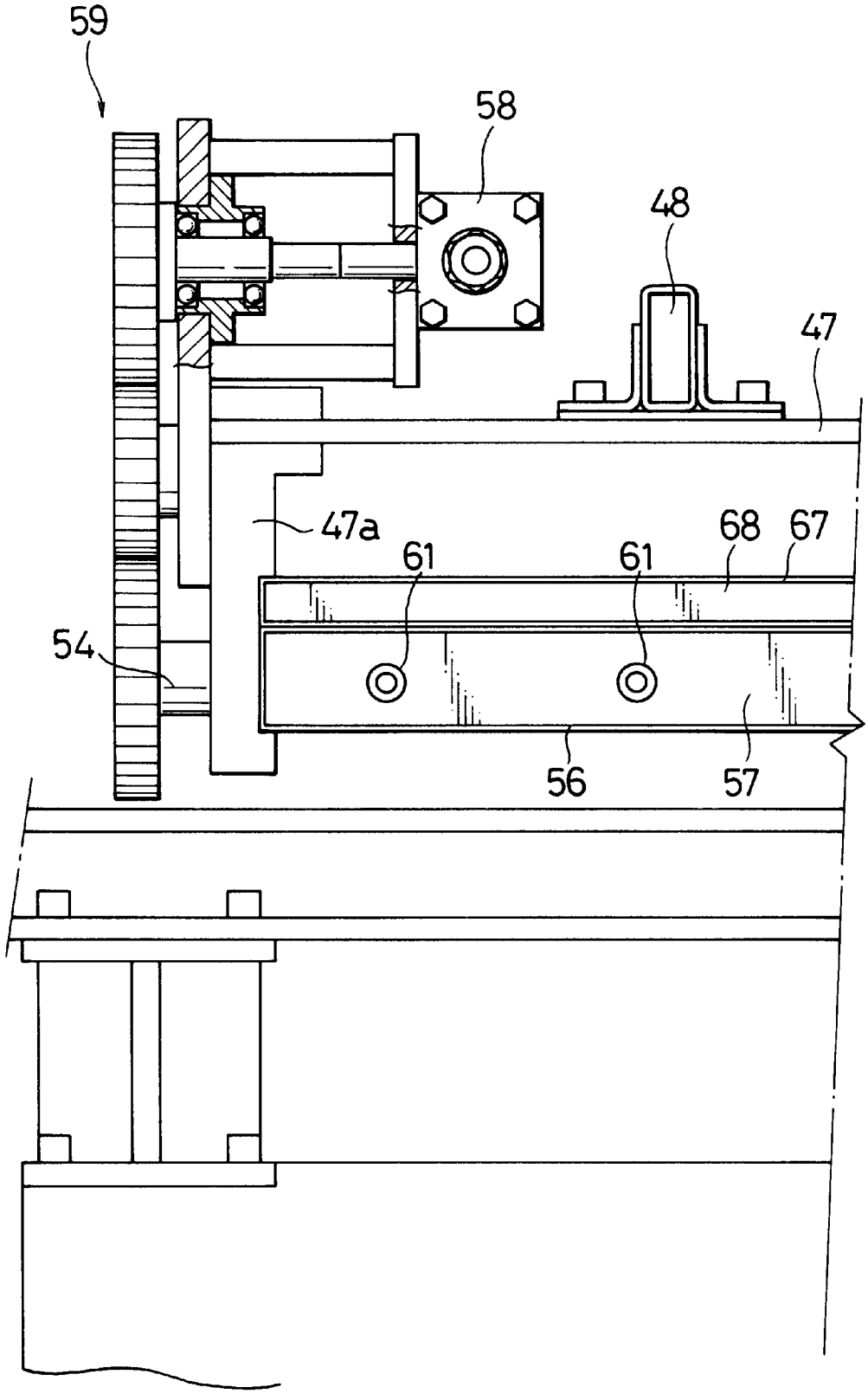
FIG. 6 shows a front view of the mechanism for reversing the transporting member of the tape transporting device of the preferred embodiment.
Figure 7:
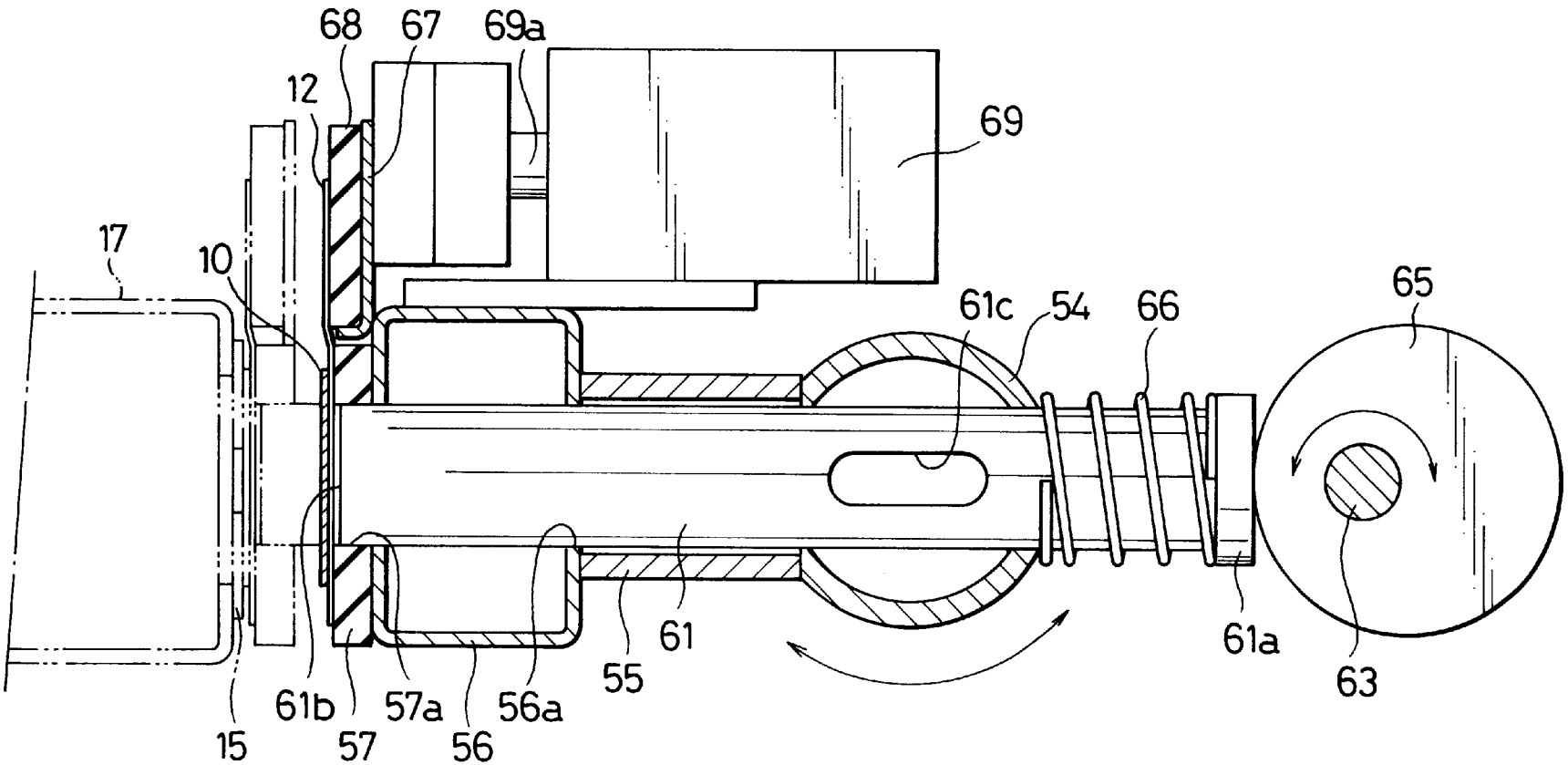
FIG. 7 shows a main sectional view of the tape transporting device of the preferred embodiment.

A hollow shaft 54 is rotatably provided between vertical portions 47*a* facing the longitudinal direction of the C-shaped frame 47. A plurality of fixing members 55 are provided on the outer periphery of the hollow shaft 54. The fixing members 55 are longitudinally spaced apart from each other at regular intervals. The main-transferring member 56, which extends in the widthwise direction of the stock paper roll 11, is fixed to open ends of the fixing members 55. As shown in FIG. 7, a main-cushion plate 57, which is made from a material resisting adherence to the double-faced adhesive tape 10 and having a predetermined elasticity, is provided on the front surface spaced apart from the fixing members 55 of the main-transferring member 56. In addition, as shown in FIG. 6, a reversible motor 58 provided on the C-shaped frame 47 is connected to one end portion of the hollow shaft 54 via gears 59, so that the main-cushion member 57 is reciprocated between a receiving posture where it faces the endless belt 15 of the tape transporting device A and an adhering posture where it faces the stock paper roll 11 situated at the standby position by forwardly and reversely rotating the hollow shaft 54 by means of the motor 58 (see FIG. 5).

A suck hose 60 connected to a vacuum sucking source (not shown) communicates with the other end of the hollow shaft 54 to develop a negative pressure within the hollow shaft 54. In addition, as shown in FIG. 7, a suck tubes 61, constituting pushing members, extend through the hollow shaft 54 in the radial direction to be slidable at positions corresponding to the fixing members 55 that retain the hollow shaft 54. A control portion 61*a* of a large diameter is provided on the rear end of each suck tube 61 protruding from the hollow shaft 54. Furthermore, an open end 61*b* at the front end of each of the suck tube 61 opens into a perforated hole 57*a* drilled in the main-cushion member 57 via a perforated hole 56*a* drilled in the main-transferring member 56. A perforated hole 61*c* is drilled in the portion of the suck tube 61 opening into the interior of the hollow shaft 54 to communicate the interior of the suck tube 61 with that of the hollow shaft 54 through the hole 61 in order to develop a negative pressure within the hollow shaft 54 and each of the suck tubes 61 due to a sucking action by the vacuum suction source. Namely, the double-faced adhesive tape 10 is sucked and thus held on the front face (a sucking and holding face) of the main-cushion plate 57*a* by each of the suck tubes 61 whose the open ends 61*b* open into the perforated hole 57 of the main-cushion plate 57.

Figure 12:
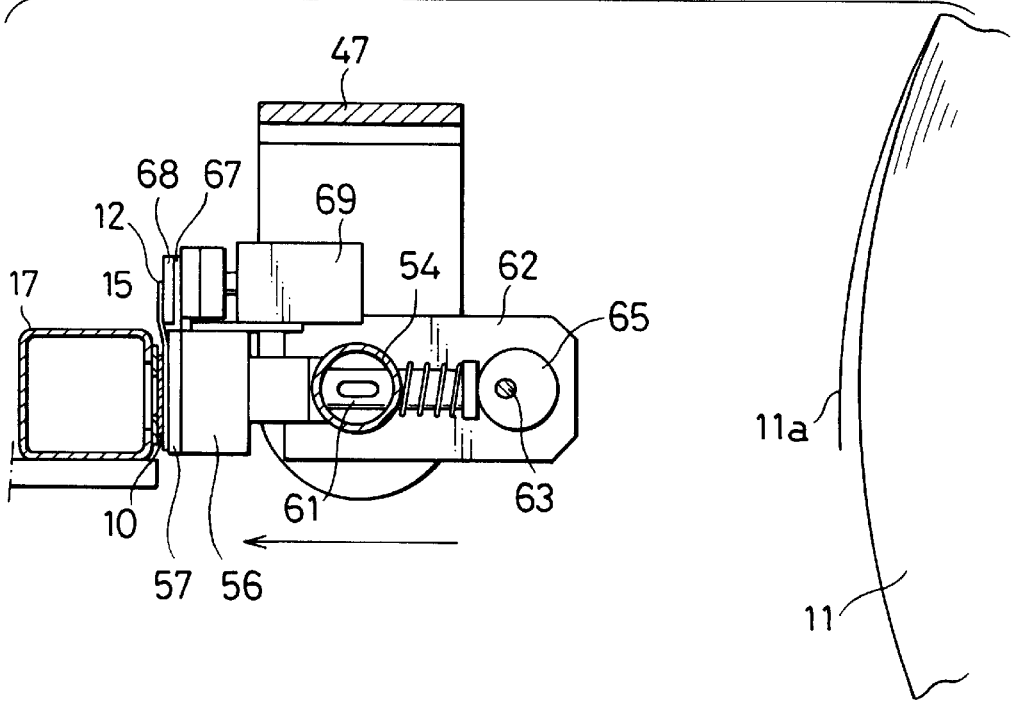
FIG. 12 shows an illustration of the situation in which the fixing adhesive tape and the double-faced adhesive tape are received from the endless belt by the tape transporting device of the preferred embodiment.

In addition, in the tape transferring device E, when the main-transferring member 56 takes the receiving posture, the double-faced adhesive tape 10 and the fixing adhesive tape 12 both of which are held on the endless belt 15 by suction are received and sucked, and thus held on the main-cushion plate 57 due to the fact that the second cylinder 53 is energized to bring the main-transferring member 56 close to the endless belt 15 (see FIG. 12). In addition, when the main-transferring member 56 takes the adhering posture, the double-faced adhesive tape 10 and the fixing adhesive tape 12 held on the main-cushion plate 57 by suction is adhered to the tip portion 11*a* of the stock paper roll 11 due to the fact that the first cylinder 52 is energized to bring the main-transferring member 56 close to the stock paper roll 11 (see FIG. 14). A torque limitter (not shown) is connected to the first cylinder 52 to control the first cylinder 52 so as to halt energization of the first cylinder 52 when it detects that a load of more than predetermined valve is applied to the first cylinder 52 owing to the abutment of the main-cushion plate 57 against the stock paper roll 11. In addition, the actions for sucking the double-face adhesive tape 10 by the tape transporting device A and by the tape transferring device E are switched on and off at appropriate times by controlling the opening and closing of valve bodies (not shown) provided in suction paths from respective vacuum sources.

As shown in FIG. 7, a plurality of auxiliary cylinders 69 are provided on the upper surface of the main-transferring member 56 taking the receiving posture. The auxiliary cylinders 69 are longitudinally spaced apart at regular intervals with their piston rods 69*a* facing the endless belt 15. The sub-transferring member 67 is provided on the piston rods 69*a* of the auxiliary cylinders 69 in a parallel relationship with the main-transferring member 56. A sub-cushion plate 68 made from the same material as the main-cushion plate 57 is provided on the front surface of the sub-transferring member 67. When the sub-cushion plate 68 takes the receiving posture facing the endless belt 15, it supports the portion of the fixing adhesive tape 12 which extends beyond the upper edge of the double-faced adhesive tape 10 sucked and thus held on the main-cushion plate 57, and as described later, it serves to push the supported portion (the extended end portion) of the fixing adhesive tape 12 against the tip portion 11*a* of the stock paper roll 11 and the stock paper roll in a bridging manner. In addition, the front surface of the sub-cushion plate 68 is set so as to be constantly flush with that of the main-cushion plate 57 and to be protruded therefrom by energizing the auxiliary cylinder 69 in the direction in which the piston rod 69*a* extends (see FIG. 15).

A plurality of brackets 62 are provided on the hollow shaft 54 and an actuation shaft 63 is rotatably provided on the brackets 62. The actuation shaft 63 is situated on the opposite side of the hollow shaft 54 from the main-transferring member 56 and is parallel to the hollow shaft 54. This actuation shaft 63 is rotated by a pushing motor 64 provided on the outermost one of the brackets 62. Eccentric cams 65 are fixed to the actuation shaft 63 at positions corresponding to those of the suck tubes 61. The control portions 61*a* of the suck tubes 61 abut against the outer peripheral surfaces of the respective eccentric cams 65. A compressive spring 66 is disposed between the hollow shaft 54 and the control portion 61*a* to bias the suck tube 61 in such a way that the control member 61*a* constantly abuts against the eccentric cam 65. In addition, when each of the eccentric cams 65 is rotated by the actuation shaft 63, the suck tube 61 is moved to and fro relative to the hollow shaft 54 and the main-transferring member 56 to make its open end 61*b* protrude from the main-cushion member 57(see FIG. 15).

The minimum outer peripheral positions of the eccentric cams 65 which are the most adjacent to the center of the actuation shaft 63 are set in common, while the maximum outer peripheral positions thereof which are the farthest from the center are set in such a way that they are different from each other. Namely, each of the suck tubes 61, which is moved to and fro while abutting against the outer peripheral surface of the corresponding eccentric cam 65 due to the rotation of the actuation shaft 63, is moved separately at predetermined time intervals. This ensures transfer of the double-faced adhesive tape 10 to the side of the stock paper roll 11 from the main-cushion plate 57. The open ends 61*b* of the suck tubes 61 open into the perforated holes 57*a* of the main-cushion plate 57 with the control portions 61*a* of the suck tubes 61 constantly abutting against the minimum outer peripheral portion of the eccentric cams 65. In addition, the auxiliary cylinders 69 are controlled so as to be energized in a synchronized manner with the rotation of the actuation shaft 63, whereby one extending end portion of the fixing adhesive tape 12 is reliably adhered to the stock paper roll of the stock paper roll 11.

The operation of the apparatus for automatically adhering tapes according to the above-described embodiment will now be described. Firstly, the strip paper 21 stripped by the stripping plate 22 from the double-faced adhesive tape 10 drawn out from the tape roll 19 is threaded through the pair of stripping rollers 24 and attached to the winding roller 25. At the same time, the tip portion of the double-faced adhesive tape 10 is set between the feed roller 23 and the endless belt 15. The stock paper roll 11 is positioned at the standby position with its tip portion 11*a* facing the endless belt 15.

Figure 8:
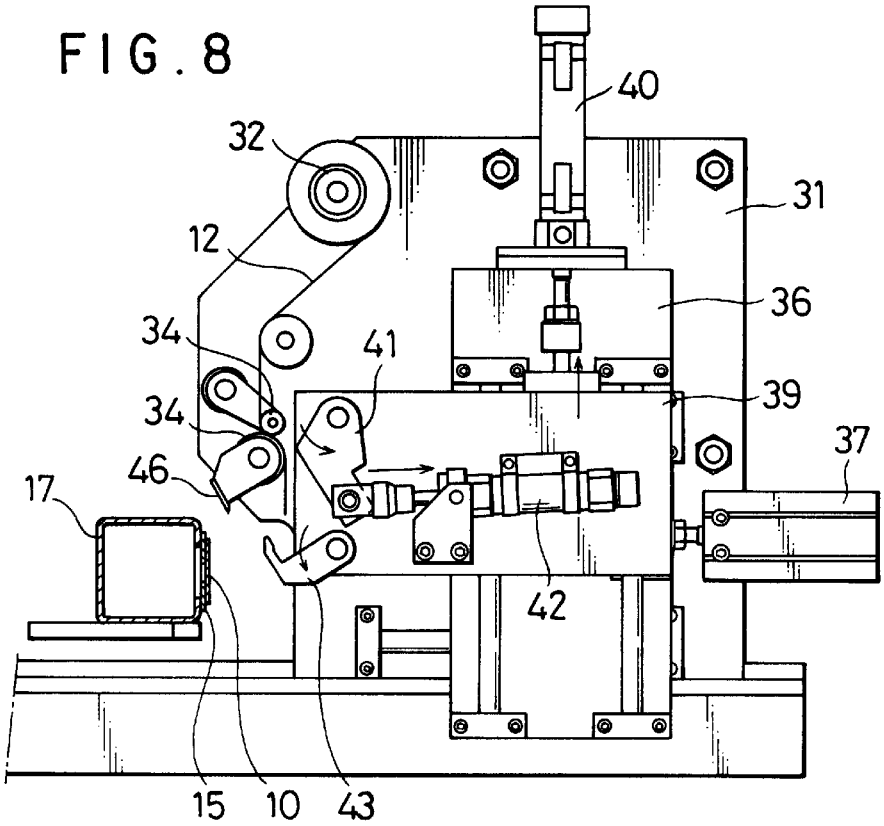
FIG. 8 shows an illustration of the situation in which the tip portion of the fixing adhesive tape is gripped by the second feeding device of the preferred embodiment.
Figure 9:
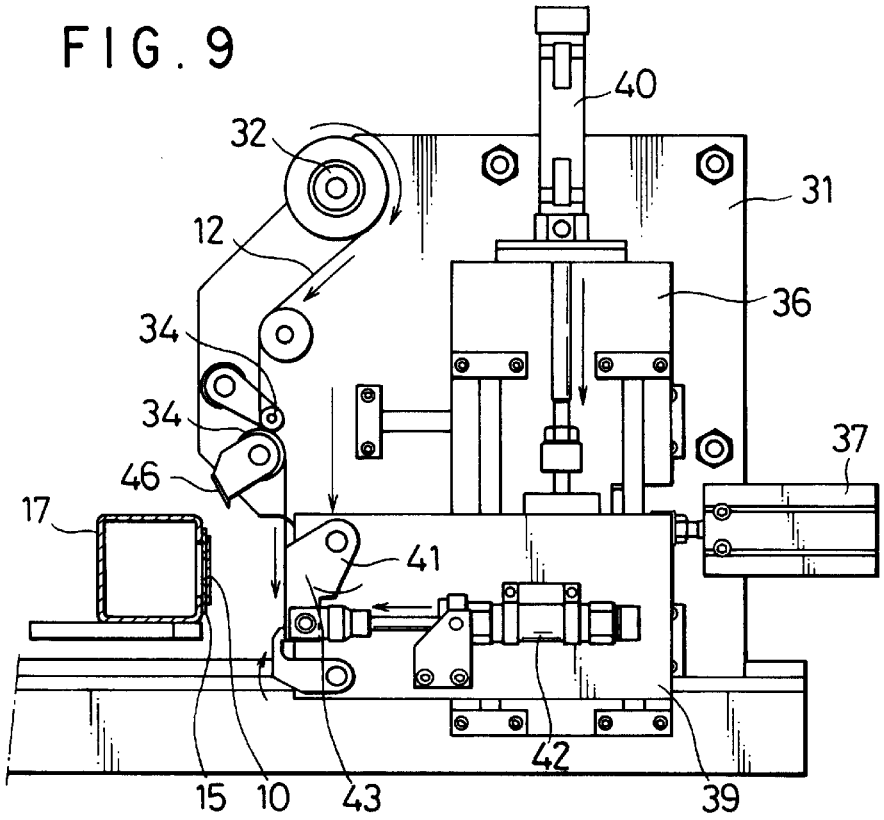
FIG. 9 shows an illustration of the situation in which the fixing adhesive tape is drawn out by the second feeding device of the preferred embodiment.

Then, when the apparatus M is started, the feed roller 23, the stripping rollers 24, the winding roller 25 and the endless belt 15 are respectively driven intermittently. Next, the double-faced adhesive tape 10 is intermittently drawn out from the tape roll 19 by a predetermined length, while at the same time the strip paper 21 is wound around the winding roller 25. The double-faced adhesive tape 10 stripped of the strip paper 21 is transported downstream with its one side being held on the transporting surface of the endless belt 15 by the suck action of the negative pressure box 17. The second feeding device D for the fixing adhesive tape is operated to draw the fixing adhesive tape 12 from the tape roll 33 loaded on the holder 32. Namely, under the condition that the adhering member 41 and the gripping member 43 are spaced apart from each other by energizing the gripping cylinder 42, as shown in FIG. 8, the second carriage 39 is moved upward to the gripping position by energizing the lifting and lowering cylinder 40. At this point, the tip portion of the fixing adhesive tape 12 suspended from the lower guide roller 34 is positioned between the adhering member 41 and the gripping member 43. Then, the adhering member 41 and the gripping member 43 are brought close to each other to grip the tip portion of the fixing adhesive tape 12 between the members 41, 43 by reversely energizing the gripping cylinder 42. When the lifting and lowering cylinder 40 is energized to lower the second carriage 39 to the drawing position, as shown in FIG. 9, a predetermined length of the fixing adhesive tape 12 is drawn out from the tape roll 33. The adhering surface of the drawn-out fixing adhesive tape 12 faces the endless belt 15.

Figure 10:
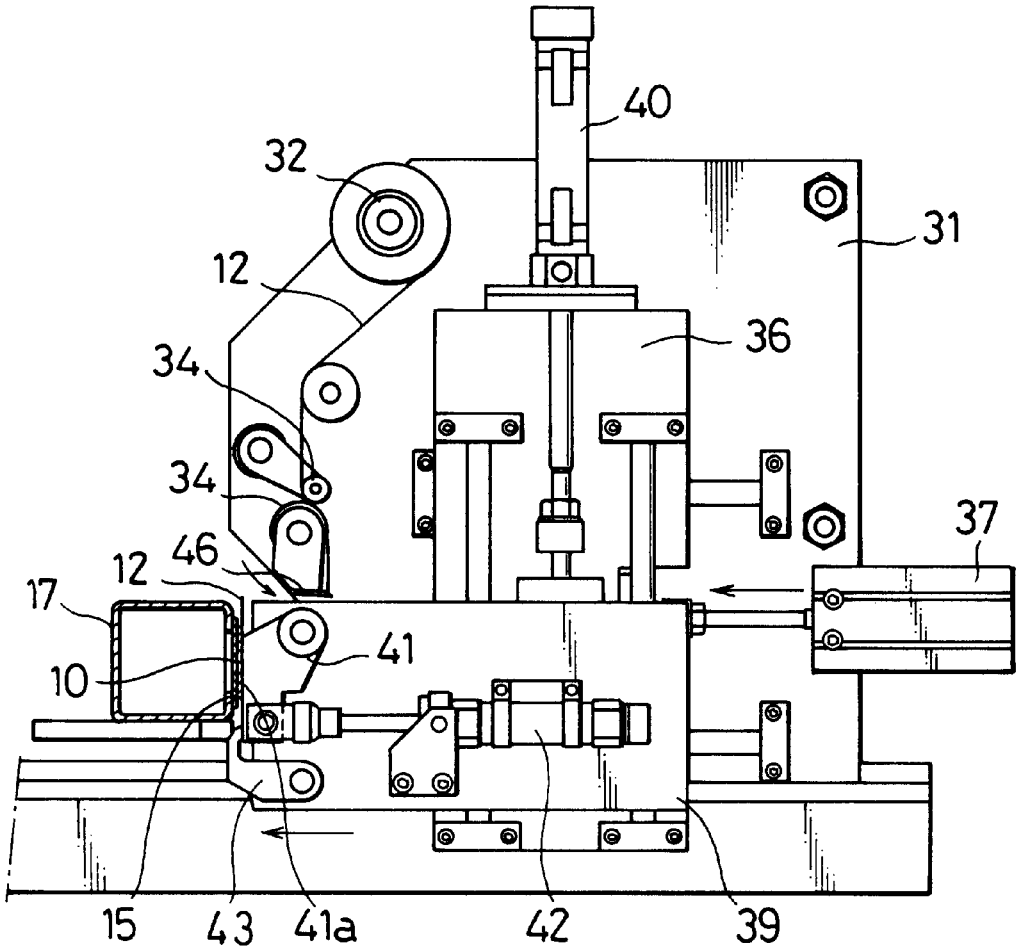
FIG. 10 shows an illustration of the situation in which the fixing adhesive tape is adhered to the double-faced adhesive tape by the second feeding device of the preferred embodiment.
Figure 11:
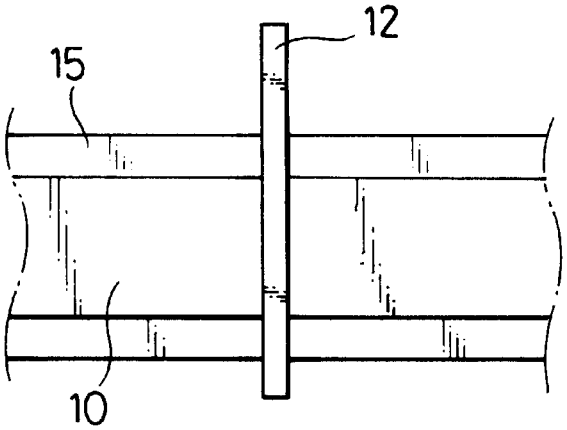
FIG. 11 shows an illustration of the situation in which the fixing adhesive tape is adhered to the double-faced adhesive tape held on the endless belt by suction.

The cylinder 37 of the second feeding device D is energized while the double-faced adhesive tape 10 is being drawn out and the transportation thereof is halted intermittently, and, as shown in FIG. 10, the first carriage 36 is moved forward to the adhering position. This causes the adhering member 41 to move toward the endless belt 15, thereby causing the fixing adhesive tape 12 held on the push surface 41*a* to be adhered to the front surface of the double-faced adhesive tape 10 held on the endless belt 15 by suction. In addition, the cylinder 45 for the knife is forwardly and reversely energized at an appropriate time to cut the fixing adhesive tape 12 at a position below the lower guide roller 34. This causes the fixing adhesive tape 12 to be adhered to the double-faced adhesive tape 10 with each of its longitudinal opposite ends extending beyond the double-faced adhesive tape 10.

After the fixing adhesive tape 12 has been adhered to the double-faced adhesive tape 10, the gripping cylinder 42 is reversely energized to space the stripping member 41 and the gripping member 43 apart from each other to release the fixing adhesive tape 12, while the cylinder 37 is reversely energized to return the carriage 36 to the standby position. Thereafter, the second feeding device D repeats the same action as described above to draw out the next fixing adhesive tape 12 to be adhered.

Every time the endless belt 15 is halted, as described above, the operation wherein the fixing adhesive tape 12 is adhered lengthwise to the double-faced adhesive tape 10 is repeated, so that a plurality of the fixing adhesive tapes 12 are adhered as spaced apart from each other by a predetermined distance in the longitudinal direction. The cutting cylinder 29 of the cutting device C positioned to face the endless belt 15 is energized at the time when the transportation of the double-faced adhesive tape 10 is halted after it has been drawn out to a length equal to the widthwise length of the stock paper roll 11. Then, the electrically heated cutting member 30 is pushed against the double-faced adhesive tape 10 by bringing the holder 28 close to the endless belt 15, thereby melting and thus cutting the tape 10. As the mechanism for cutting the double-faced adhesive tape 10, the cutting device C is better able to constantly accomplish reliable cutting than a serrated knife, whose cutting quality degrades over time.

After the double-faced adhesive tape 10 has been cut by melting, it is transported by continuous travel of the endless belt 15 to the position where it faces the stock paper roll 11 at the standby position. At this point, since the main- and sub-transferring members 56, 67 of the tape transferring device E take the receiving posture facing the endless belt 15, the energizing of the second cylinder 53 makes the transferring members 56, 67 close to the endless belt 15. Further, as shown in FIG. 12, when the main-cushion plate 57 abuts against the double-faced adhesive tape 10 held on the endless belt 15 by suction, the suck action of the tape transporting device A is switched off, and the suck action of the tape transferring device E is simultaneously switched on. As a result, the double-faced adhesive tape 10 is received by the main-cushion plate 57 from the endless belt 15 to be sucked and held on the front surface of the cushion member 57. The double-faced adhesive tape 10 and the fixing adhesive tape 12 are transferred to the main-transferring member 56 by reversely energizing the second cylinder 53 to space the main and the sub-transferring members 56, 67 apart from the endless belt 15. At this point, one end portion of each fixing adhesive tape 12 which extends upwardly from the double-faced adhesive tape 10 is supported by the front surface of the sub-cushion plate 68.

Figure 13:
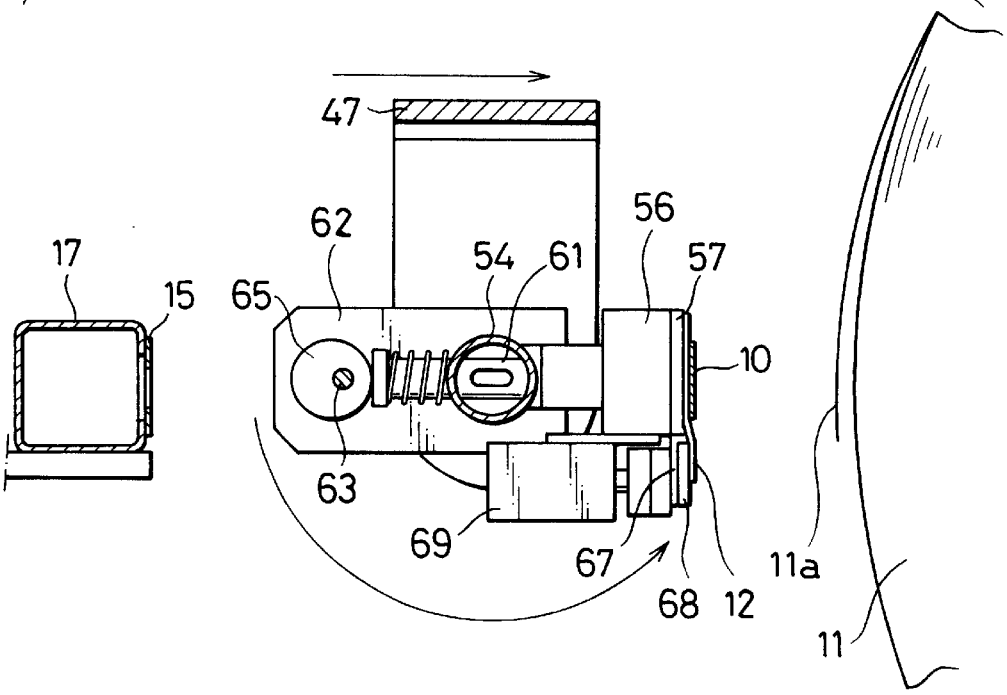
FIG. 13 shows an illustration of the situation in which the fixing adhesive tape and the double-faced adhesive tape received by the tape transporting device of the preferred embodiment are oriented toward the stock paper roll.
Figure 14:
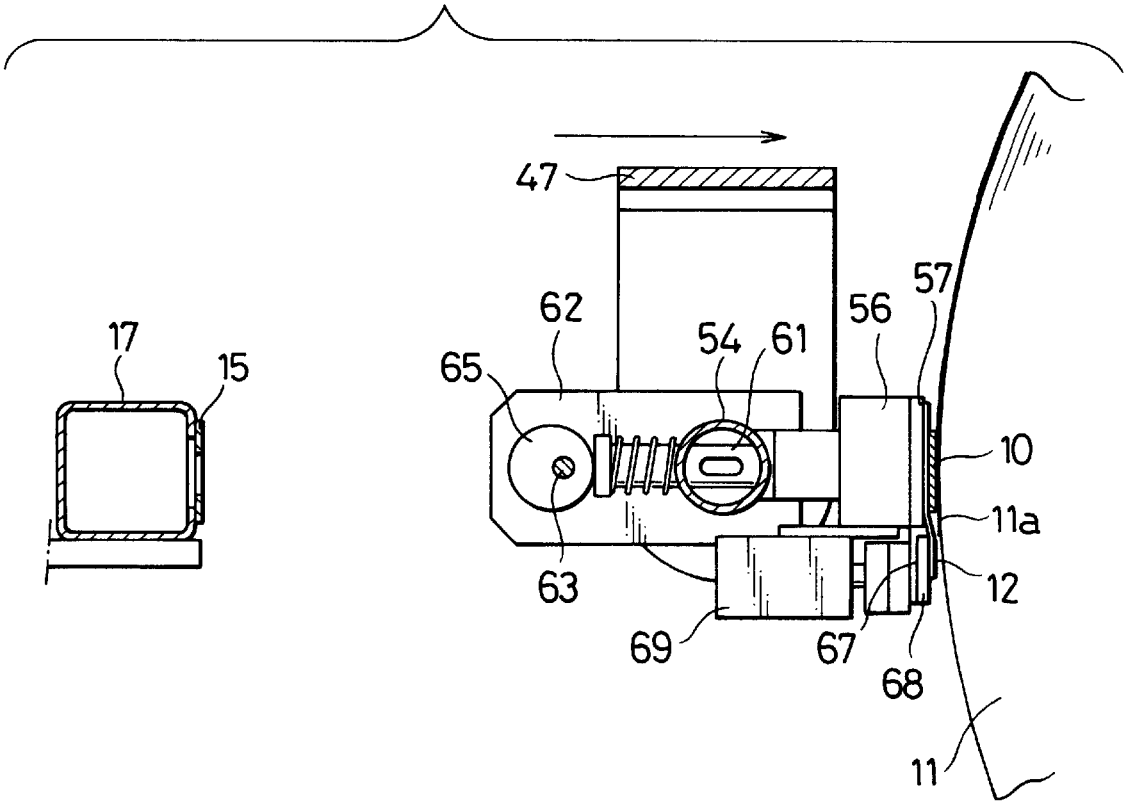
FIG. 14 shows an illustration of the situation in which the fixing adhesive tape and the double-faced adhesive tape are adhered to the stock paper roll by the tape transporting device of the preferred embodiment.

When the energizing of the second cylinder 53 is halted, the reversible motor 58 is operated to reverse the main- and sub-transferning members 56, 67 in such a way that the members 56,67 take the adhering posture at which they face the stock paper roll 11 at the standby position, as shown in FIG. 13. In this adhering posture, one end portion of the fixing adhesive tape 12 which extends downwardly from the double-faced adhesive tape 10 is supported by the front surface of the sub-cushion plate 68. Then, when the first cylinder 52 is energized, as shown in FIG. 14, the main and sub-transferring members 56, 67 are integrally moved to a position close to the stock paper roll 11, and then the main- and sub-transferring cushion plates 57, 68 come into abutment against the outer peripheral surface of the stock paper roll 11. This causes the double-faced adhesive tape 10 held on the main-cushion plate 57 by suction to be pushed against and thus adhered to the tip portion 11*a* of the stock paper roll 11. The portion of each of the plurality of the fixing adhesive tapes protruding vertically from the double-faced adhesive tape 10 and adhered to the double-faced adhesive tape is pushed and thus adhered in a bridging manner between the tip portion 11*a* and the stock paper roll by the main- and sub-cushion plates 57, 68 (see FIGS. 15 and 16). If a load of more than a predetermined value is applied to the first cylinder 52 owing to the abutment of the main-cushion plate 57 against the outer peripheral surface of the stock paper roll 11, the limit switch detects this load to halt energizing of the first cylinder 52. The suck action by the tape transferring device E is also stopped.

Figure 15:
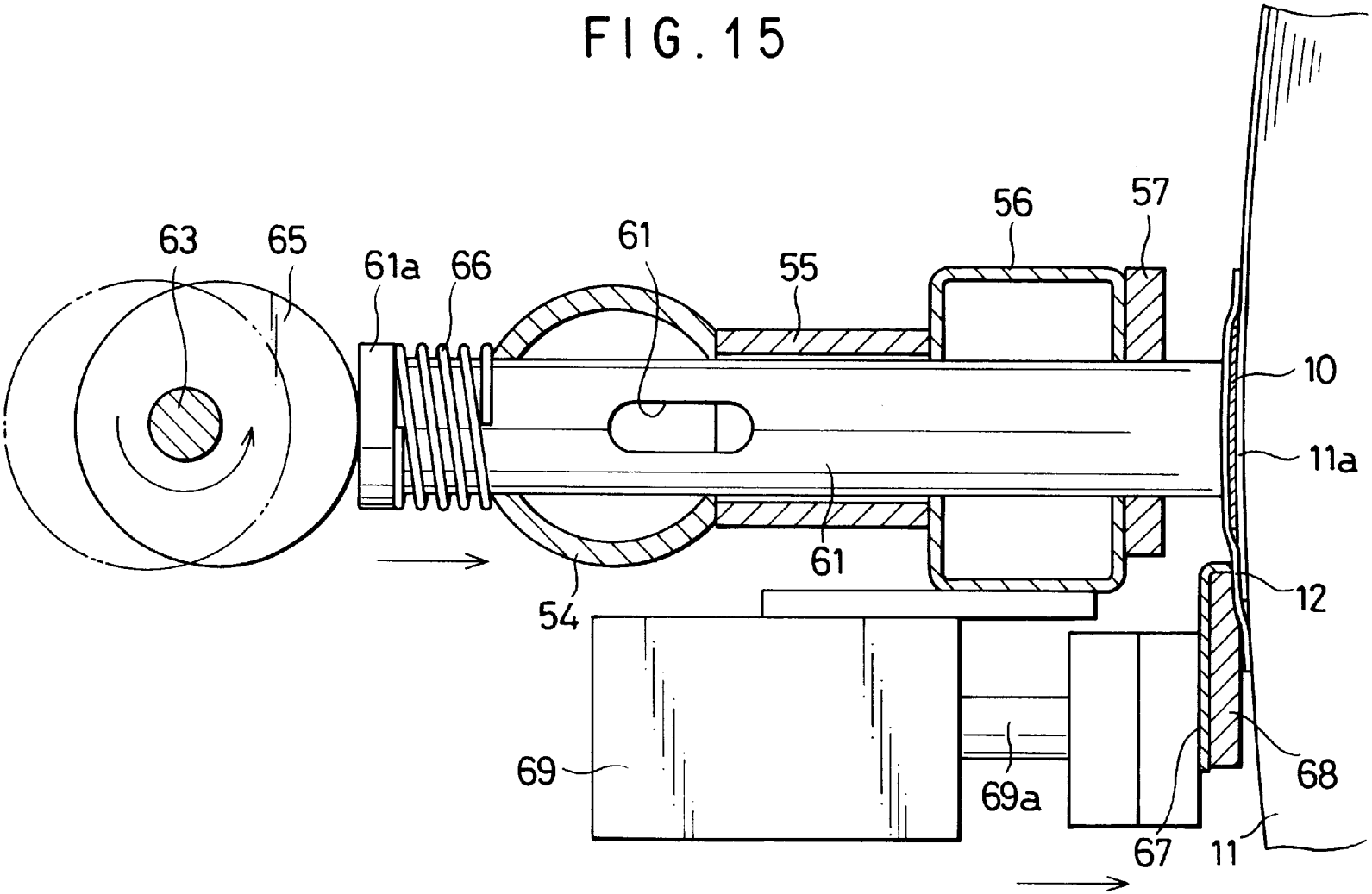
FIG. 15 shows an illustration of the situation in which the double-faced adhesive tape is securely transferred to the stock paper roll by the suck tube of the tape transporting device of the preferred embodiment.

Then, the first cylinder 52 is reversely energized to space the main-transferring member 56 apart from the stock paper roll 11, while the push motor 64 is activated to rotate the actuation shaft 63. The rotation of the actuation shaft 63 causes the suck tubes 61 abutting against the outer peripheral surfaces of the respective eccentric cams 65 to be moved relative to the main-transferring member 56 in response to the rotation of the corresponding cams 65, and thereby causing the open end 61*b* to protrude forwardly from the main-cushion plate 57, as shown in FIG. 15. Namely, since the main-cushion plate 57 is moved away from the paper roll 11 with the double-faced adhesive tape being pushed against the stock paper roll 11 by the front end 61*b* of the suck tube 61 having a small area, the tape 10 is assuredly prevented from being stripped from the stock paper roll 11 due to the fact that the tape 10 is adhered to the side of the cushion plate 57. Since the times at which each of the suck tubes 61 protrudes is not the same, the double-faced adhesive tape 10 is reliably transferred from the main-cushion plate 57 to the stock paper roll 11.

In addition, the auxiliary cylinder 69 is energized in the direction in which its piston rod 69*a* extends in accordance with the timing of the rotation of the actuation shaft 63. Namely, as shown in FIG. 15, the main-transferring member 56 is spaced apart from the stock paper roll 11, while, on the other hand, the sub-cushion plate 68 of the sub-transferring member 67 keeps on pushing the fixing adhesive tape 12 against the peripheral surface of the stock paper roll 11. This causes the main-cushion plate 57 to be spaced apart from the stock paper roll 11 while one extending end portion of the fixing adhesive tape 12 is pushed against the position between the tip portion 11*a* of the stock paper roll 11 and the side of the stock paper roll. Therefore, when the main-cushion plate 57 is spaced apart from the stock paper roll 11, the extending end portion of the fixing adhesive tape can be prevented from being stripped from the side of the stock paper roll 11.

Namely, according to this embodiment of the apparatus M for automatically adhering tapes, since the double-faced adhesive tape 10 for splicing papers and the fixing adhesive tape 12 which prevents the tip portion 11*a* from being detached from the stock paper roll are automatically adhered to the tip portion 11*a* of the stock paper roll 11, labor can be saved. Furthermore, since the tapes 10, 12 are adhered to the stock paper roll 11 at one time, the time required for this operation can be shortened.

The present invention is not limited to the configuration of the above-described embodiment and other configurations can be adopted. For instance, a single cylinder can be adopted as the transferring member of the tape transferring device in order to effect the movement relative to the endless belt as well as the movement relative to the stock paper roll. In addition, while in the embodiment, the transferring member is moved toward or away from the stock paper roll positioned, the stock paper roll may be moved toward or away from the transferring member which received the double-faced adhesive tape. Further, in place of the motor, the combination of a fluid pressure cylinder with a rack-pinion may be adopted as means for reversing the transferring member. Still further, although in the embodiment, the transferring member is divided into the main-and sub-transferring members and the sub-transferring member is independently moved by the auxiliary cylinder, the main- and sub-members can be united and the auxiliary cylinder can be omitted.

In addition, while in the embodiment the suck tube for sucking and thus holding the double-faced adhesive tape on the transferring member serves as a pushing member, a pushing member may be provided, apart from the suck tube. Besides, a knife or a cutter can be used as means for cutting the double-faced adhesive tape, depending on the material of the tape.

According to the apparatus and method for automatically adhering tapes of the present invention, since the double-faced adhesive tape and the fixing adhesive tape can be automatically adhered to the tip portion of the stock paper of the stock paper wound roll, labor can be saved and the automation can be accomplished as well. In addition, sine both tapes can be adhered at one time, advantages effects such as the shortening of labor time, the lightening of workload, or the like can be attained.

Since the double-faced adhesive tape is melted and cut by the electrically heated cutting member, unlike the serrated knife whose cutting quality degrades due to the adherence of grounds of the adhesive to the knife, it can reliably be melt and cut all the time and the maintenance of the cutting member can readily be conducted. Further, since the double-faced adhesive tape is pushed against the side of the stock paper wound roll when the transferring member and the roll are relatively moved apart form each other after the double-faced adhesive tape is adhered to the stock paper wound roll, the double-faced adhesive tape can be reliably transferred from the transferring member to the stock paper wound roll.

The present invention has been described with reference to the preferred embodiments thereof which are intended to be illustrative rather than limiting. Various changes and modifications may be made without departing from the sprit and scope of the present invention in the following claims.

What is claimed is:

1. An apparatus for automatically adhering tapes, which adheres a double-faced adhesive tape to a tip portion of a stock paper roll around which a stock paper is wound and adheres at least one fixing adhesive tape so as to bridge said tip portion and said stock paper roll, said apparatus comprising:

means for transporting said double-faced adhesive tape which includes an endless belt transporting said double-faced adhesive tape while at the same time holding said double-faced adhesive tape on its transporting surface;

means for feeding said double-faced adhesive tape which feeds said double-faced adhesive tape to said transporting surface of said endless belt while simultaneously stripping a strip paper adhered to one face of said double-faced adhesive tape;

means for feeding said fixing adhesive tape which cuts a continuous fixing adhesive tape to a predetermined length and adheres said cut fixing adhesive tape by an adhering surface thereof to said double-faced adhesive tape held on said endless belt with a portion of said fixing adhesive tape extending beyond said double-faced adhesive tape;

means for cutting said double-faced adhesive tape to a predetermined length; and means for adhering said double-faced adhesive tape and said fixing adhesive tape including posture changeable means which takes a first posture in which said double-faced adhesive tape and said fixing adhesive tape both held on said endless belt are received and a second posture in which said double-faced adhesive tape and said fixing adhesive tape are adhered, said posture changeable means receiving said double-faced adhesive tape and said fixing adhesive tape at said first posture is shifted to take said second posture, whereby said posture changeable means and said stock paper roll are brought close in order for said double-faced adhesive tape to be adhered to said tip portion of said stock paper and in order for said fixing adhesive tape to be adhered to and bridge said tip portion of said stock paper and said stock paper roll.

2. The apparatus according to claim 1, wherein said means for cutting the double-faced adhesive tape includes a cutting member which extends vertically relative to the said transporting surface of said endless belt and is electrically heated, whereby said cutting member is pushed against said double-faced adhesive tape to melt and thus cut said double face adhesive tape.

3. The apparatus according to claim 1, wherein said posture changeable means reverses from said first posture to said second posture.

4. The apparatus according to claim 1, wherein said means for adhering the double-faced adhesive tape includes pushing means protrudable from a holding surface of said posture changeable means which pushes said double-faced adhesive tape against a side of said stock paper roll and said posture changeable means and said stock paper roll are relatively moved away after said double-faced adhesive tape is adhered to said tip portion of said stock paper.

5. The apparatus according to claim 4, wherein said means for adhering the double-faced adhesive tape includes a plurality of pushing members provided along the longitudinal direction of said double-faced adhesive tape and spaced apart from each other by a predetermined distance, whereby the timing of pushing by each of said pushing members is set in such a way that the timings of pushing by the respective pushing members are different from each other.

6. The apparatus according to claim 1, wherein said posture changeable means includes a first posture changeable member for holding said double-faced adhesive tape and said fixing adhesive tape, and a second posture changeable member for holding said protruding portion of said fixing adhesive tape.

7. The apparatus according to claim 1, wherein said posture changeable means includes:

means for halting the actuation of said posture changeable means if a load of more than a predetermined value is applied to said stock paper roll when said posture changeable means taking said second posture adheres said double-faced adhesive tape and said fixing adhesive tape to said stock paper roll.

* * * * *